United States Patent [19]

Campbell

[11] 4,279,741

[45] Jul. 21, 1981

[54] METHOD AND APPARATUS FOR CENTRIFUGALLY SEPARATING A HEAVY FRACTION FROM A LIGHT WEIGHT FRACTION WITHIN A PULP MATERIAL

[75] Inventor: Thomas P. Campbell, Spokane, Wash.

[73] Assignee: Intercontinental Development Corporation, Spokane, Wash.

[21] Appl. No.: 36,517

[22] Filed: May 7, 1979

[51] Int. Cl.[2] ..... B03B 5/12

[52] U.S. Cl. ..... 209/44; 209/427; 209/486; 209/498; 233/27

[58] Field of Search ..... 209/44, 423, 425, 427, 209/453, 466, 468, 486, 497, 498, 144, 211; 210/377, 78, 369; 233/40–44, 27

[56] References Cited

U.S. PATENT DOCUMENTS

| | | | |
|---|---|---|---|
| Re. 11,367 | 9/1893 | Peck | 233/5 |
| 1,589,097 | 6/1926 | Behr | 210/369 X |
| 1,625,369 | 5/1899 | Tribe | 210/385 |
| 2,161,476 | 6/1939 | Leja | 233/3 |
| 2,724,549 | 11/1955 | Brown | 233/2 |
| 3,799,343 | 3/1974 | Lang | 210/78 |
| 3,844,414 | 10/1974 | Jordison | 209/468 X |
| 3,864,256 | 2/1975 | Hultsch et al. | 210/78 |
| 4,056,464 | 11/1977 | Cross | 209/44 X |

FOREIGN PATENT DOCUMENTS

| | | | |
|---|---|---|---|
| 139259 | 10/1961 | U.S.S.R. | 209/427 |

OTHER PUBLICATIONS

Taggart, *Handbook of Mineral Dressing*, John Wiley & Sons, Inc., N.Y., N.Y., 1945, pp. 11-01-11-55.

*Primary Examiner*—Ralph J. Hill
*Attorney, Agent, or Firm*—Wells, St. John & Roberts

[57] ABSTRACT

A centrifugal jig receives a pulp material within a rotating cylindrical jig bed for the purpose of separating the pulp into a selected heavy fraction and a lightweight fraction. The jig bed is cylindrical. It is rotated to produce an outward centrifugal force on the pulp material that is substantially greater than the force of gravity. A liquid is pulsed inwardly to produce a fluidic bed within the rotating jig bed to permit settling and separation of the heavy fraction from the lightweight fraction. The heavy fraction is screened and passed radially outward to be collected outside the bed. The lightweight fraction or tailings are moved over a discharge edge of the jig bed and are collected at a station remote from the heavy fraction collection area.

20 Claims, 7 Drawing Figures

10
11
12
13
15
16
17
18
20
21
24
25
27
28
29
31
32
33
34
35
36
37
38
41
44
50
51
52
53
54
56
P

METHOD AND APPARATUS FOR CENTRIFUGALLY SEPARATING A HEAVY FRACTION FROM A LIGHT WEIGHT FRACTION WITHIN A PULP MATERIAL

BACKGROUND OF THE INVENTION

The present invention relates to jigs for separating ore concentrate from pulp material and more particularly to such jigs utilized to separate a heavy fraction and a lightweight fraction.

The mineral jig, as defined by Arthur F. Taggert in his book entitled "Handbook of Mineral Dressing, Ores and Industrial Minerals" published by John Wiley & Sons, Inc. (4th Printing, September, 1950), is a "mechanical concentrator that effects a separation of heavy grains from light by utilizing differences in the abilities of the grains to penetrate a semi-stationary bed". Essentially it is a box with a perforate bottom and no top in which a relatively short range separating bed is formed by pulsating water currents. The "separating bed" is expanded when loosened by the water pulsation to form a "fluidic bed". The material may include "ragging" comprised of loosely collected particles of a selected size resting on a sieve.

The pulp material is passed over the ragging and sieve and therefore becomes an integral part of the "jig bed". Water pulsations are directed upwardly through the sieve and remainder of the jig bed to periodically create a fluidic bed with the pulp material. The lightweight fraction of the pulp will be pulsed upward through the fluidic bed while heavier fractions may move upwardly to a substantially lower elevation. After the pulsation, the lightweight fraction tends to settle slightly while the heavier specific gravity fraction settles more quickly through the intersticies between adjacent pulp material and the ragging (if used). After a series of pulsations, the heavier fraction will settle to the bottom of the bed while the lighter fraction or "tailings" move to the top and are shifted away from the bed by more incoming pulp material.

The mineral jig, as used today, is essentially a combination of two types of gravity separation systems, namely the rising current classifier and the heavy media separator. In order to understand how the mineral jig operates effectively, both systems must be addressed simultaneously.

The passage of fluid upward, or in opposition to settling forces acting upon the feed, acts to hinder or prevent the settling of particles from the feed. It is a fact that during classification within a rising current classifier, particles of varying density will settle at unequal rates. In applying this to a mineral pulp, small particles of heavy material would settle with larger particles of a lighter material, thus effectively preventing a close concentration of the heavy particles.

In a heavy media or sink-float system, separation of particles is achieved due to the differences in specific gravities of the particles. Within certain parameters the size of the particles has no effect on the separation, for a particle of one specific gravity or density which is less dense than the media will not settle at all but will remain at the surface of the media while the particle which is of greater density will settle through the media.

In a mineral jig, the upper layers of material represent the settling of particles as in a rising current classifier while the lower layers (ragging), being sustained in a fluid condition by proper pulsation, represent the action of a dense media. Thus it will be seen that large, less dense particles of material will settle through the upper layers of the jig bed to eventually encounter the lower heavier media layers where they will be rejected at that level.

This action cannot be detailed except in theory. However, it has been found that if proper layering of the jig bed cannot be attained then the concentration efficiency will be reduced or the machine may not operate effectively. The formation of effective layers of material within the jig bed is therefore of prime importance to successful operation of the jig.

Great effort and ingenuity have been expended to produce jig beds that will maintain the preferred layering along at least theoretically defined planes that are normal to the direction of pulsation. One method to accomplish this is to provide a perfectly horizontal sieve upon which to form the jig bed and providing a continuous, even feed to the bed. Such beds must be held rigidly in the horizontal orientation, otherwise the bed material will shift in one direction or another causing build-up in one area of the bed and decreasing the layer thickness in another area where the fluid pulsations will break through. The result is "boiling" in the jig bed which, in turn, upsets the efficiency of the entire bed for effectively separating the feed as desired.

Horizontal bed jigs are in current use worldwide. They typically are used with water pulsations which may be pulsed upwardly, downwardly, or both upwardly and downwardly alternately. Alternatively, the bed itself is "jigged" to produce the pulsing effect. The upward pulsation causes the fluidic bed to form and gravity acts to move the high specific gravity particles downwardly in the bed to form a concentration of the selected ore. Theoretically, gravity may be augmented by a reverse suction stroke following a positive pulsation. The suction stroke, conceivably, operates against the pulp material to increase the settling rate of the heavier, more dense particles. However, the suction produced by the pulsating water acts not only upon the heavy particles but also on the ragging and lightweight fraction as well. Often, the result is a packing of the jig bed that cannot be loosened by successive positive pulsations. Therefore, jigs that utilize only positive pulsations of water often prove more effective than those using both positive and negative (suction) pulsations.

The absolute requirement of formation of a uniform fluidic bed within a jig has dictated the horizontal, flat shape of conventional jigs. Even so, attempts have been made to increase gravity separation rate by rotating the jig bed to add a radial centrifugal force component greater than the pull of gravity to the settling particles. Attempts at this have been frustrated in the past mainly because the jig bed would not remain even. At best, such apparatus function as classifiers, and are not at all effective as concentrators.

U.S. Pat. No. 4,056,464 granted to D. J. Cross on Nov. 1, 1977, discloses a "jig" that utilizes a frusto-conical rotating bed for receiving pulp material. A slurry is placed on the rotor and is subjected to pulsations about its periphery. It is claimed that heavy material will pass through the screen (comprising the frusto-conical configuration) to be concentrated prior to collection while lighter material will move up the "bed" and spill over the edge for separate collection. The difficulty is that the rotating, frusto-conical screen produces outward centrifugal forces that are unequal along the rotating axis. For example, a particle near the vortex of the frusto-cone will have an outward, centrifugal force of, say, two times the force of gravity or 2 G's. A particle near the enlarged base of the frusto-cone having the same mass would experience a much heavier centrifugal G loading. Inward pulsations required to create a fluidic bed must oppose the centrifugal force acting upon the particles, causing them to settle. Therefore, a "fluidizing" force acting upon the particle rotating at a greater radius from the axis of rotation would necessarily be greater than that required to fluidize or lift a particle at a smaller radius from the rotating axis. The bed would therefore become uneven if it weren't held in place by the disclosed baskets. With the ragging material thus held in place, the device acts as a rotating screen, collecting some concentrate but primarily classifying the feed material.

Cross discloses in FIG. 7 of his drawings an upper cylindrical portion of the rotating frusto-cone. This area of the "jig", since it is at the maximum diameter of the frusto-cone, is inundated with pulp material that has been passed at increasing velocity over the conical sides. If the cylindrical area of the bed is to be fluidized, the force of the pulsation required to lift and open the bed at the maximum radius from the axis of rotation would be substantially greater than that required to fluidize the remainder of the "bed" held by the frusto-conical screen below. Therefore, the fluidic bed at the cylindrical screen cannot be properly fed due to the turbulence of boiling material caused by the pulsations against the feed along the frusto-conical sides.

It therefore remains desirable to obtain some form of apparatus that will effectively and at a relatively high rate of speed, separate fine heavy particles from lightweight particles in a pulp material.

The present invention was conceived to solve the problem by producing a cylindrical true "jig bed" that will maintain an even, layered bed while being rotated about a fixed axis. With such a bed formation, and with positive pulsation, increased settling rates may be achieved through the increased settling forces applied to the particles by centrifugal force.

DETAILED DESCRIPTION OF A PREFERRED AND ALTERNATE EMBODIMENT

Figures 1, 2:
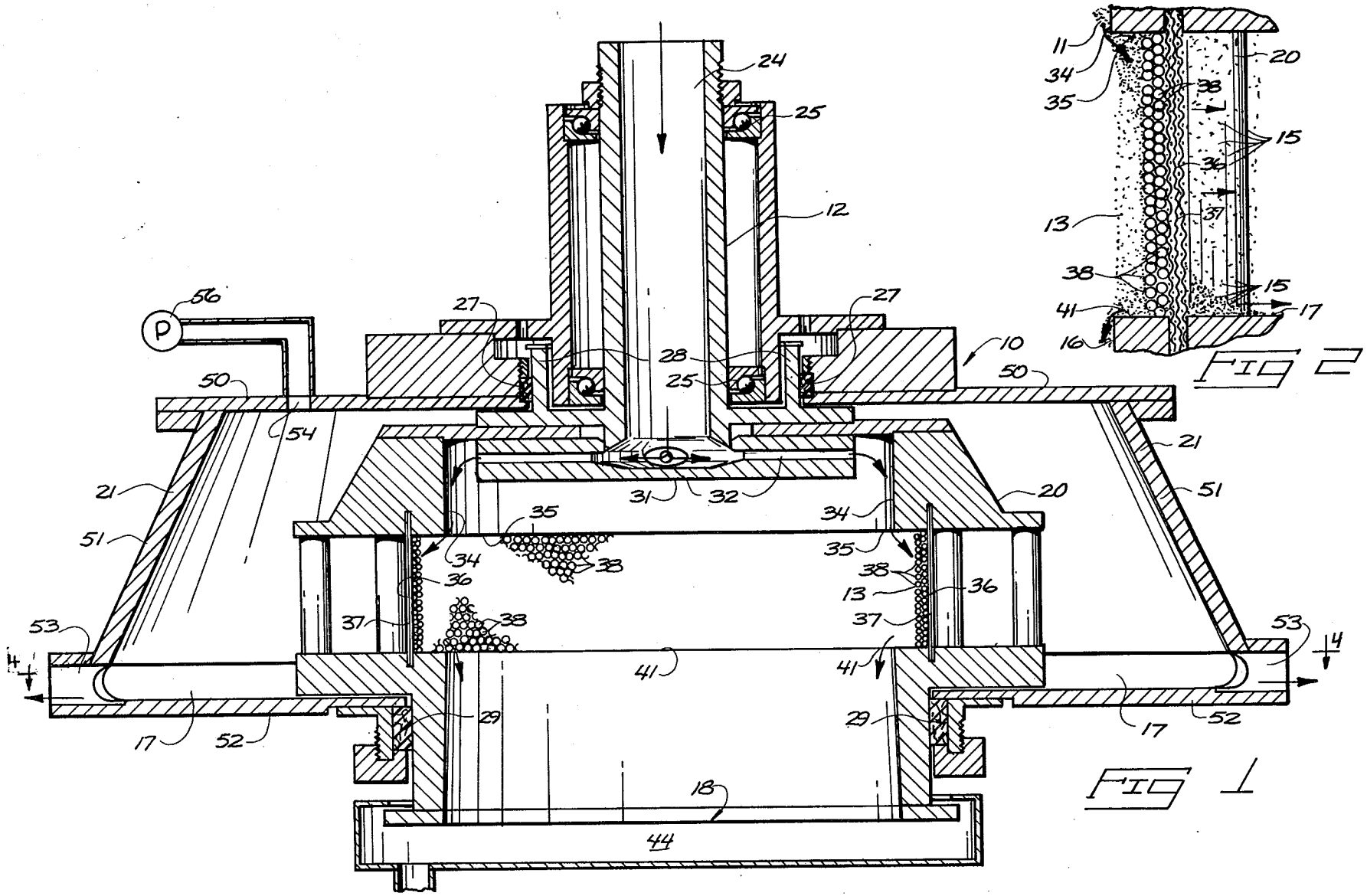
FIG. 1 is a half sectional view of one form of the present centrifugal jig.
FIG. 2 is an enlarged fragmentary view of a portion of the jig bed of the FIG. 1 embodiment during operation.
Figure 3:
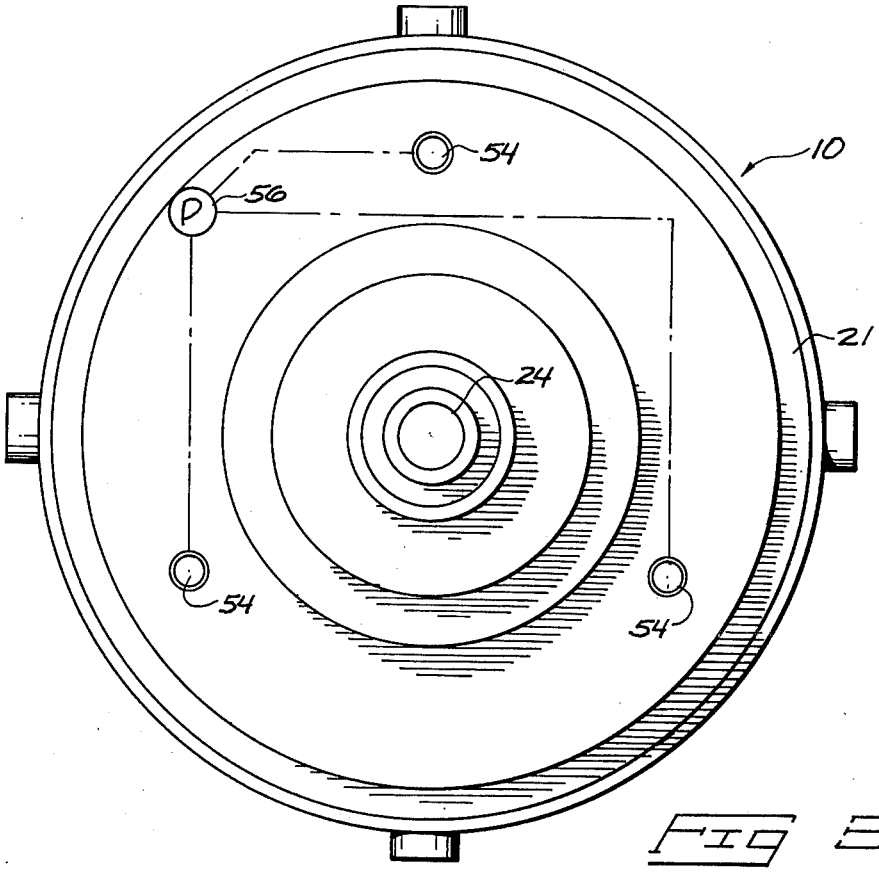
FIG. 3 is a slightly reduced plan view of the jig as seen from above in FIG. 1.
Figure 4:
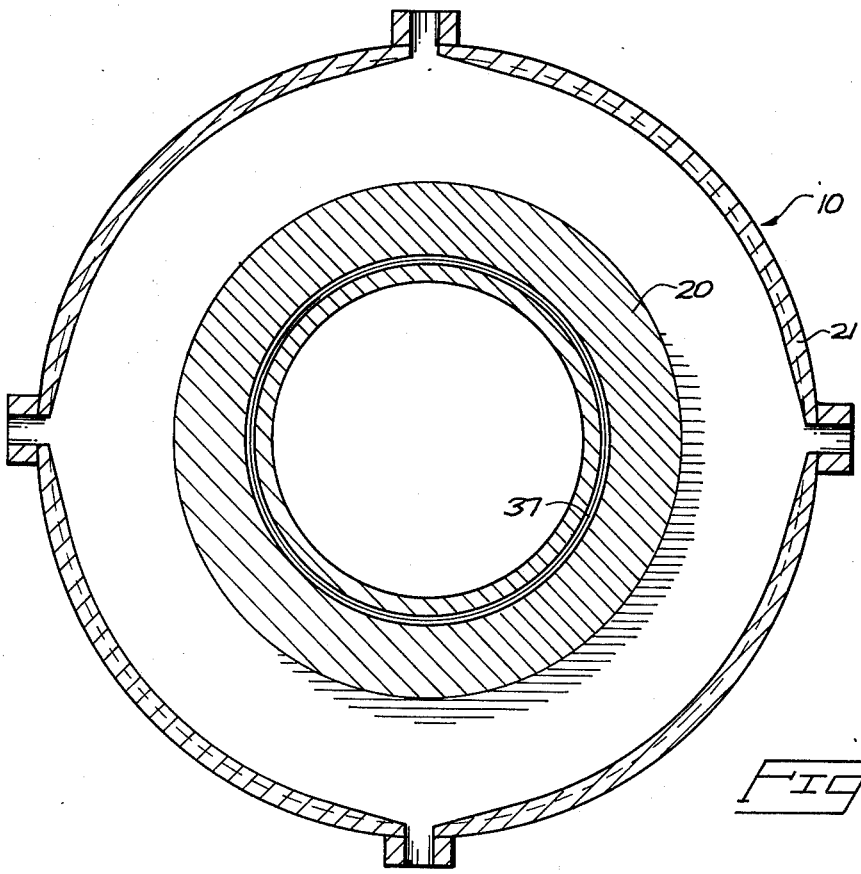
FIG. 4 is a reduced sectional view taken along line 4—4 in FIG. 1.
Figure 5:
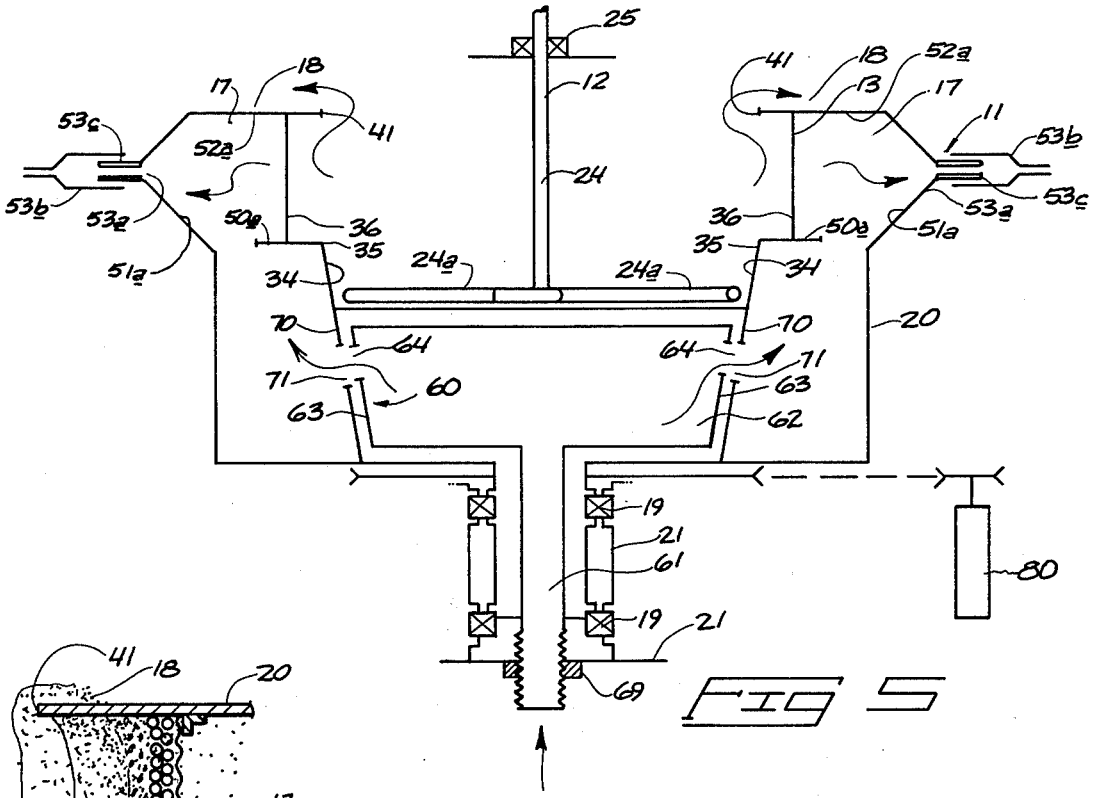
FIG. 5 is a diagrammatic sectional view of an alternate form of the present jig.
Figure 6:
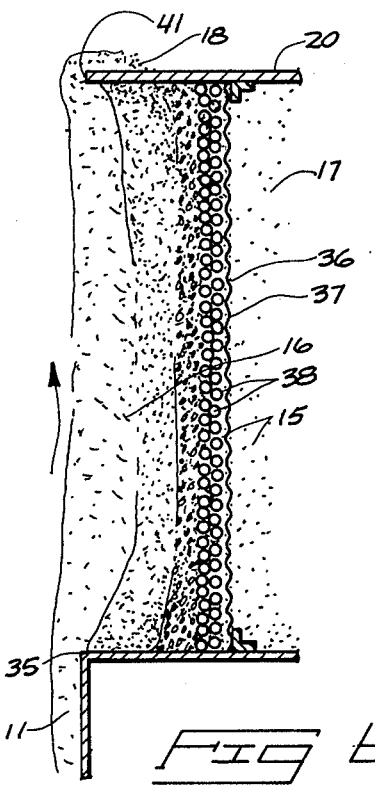
FIG. 6 is a view similar to FIG. 2 only showing operation of the FIG. 5 embodiment and also showing the general formation of the jig bed in greater detail.
Figure 7:
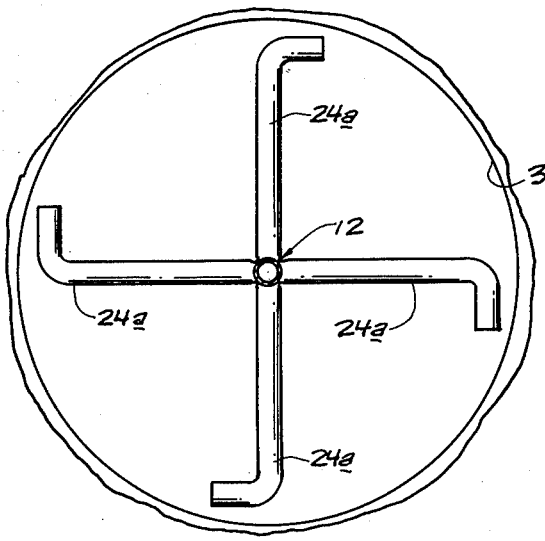
FIG. 7 is an enlarged diagrammatic view of the pulp discharge pipes for the FIG. 5 embodiment.

Two related embodiments of the invention are illustrated in the drawings, a first embodiment being shown in FIGS. 1-4, and a second embodiment being shown in FIGS. 5-7. Components of the jig forms shown in FIGS. 1 and 5 are taken along sectional planes passing vertically through the centers of the jigs. Elements of the jig common to both illustrated embodiments are identified in the drawings by identical reference numerals. The differences that exist structurally within the two forms of the invention will be discussed herein with respect to each operational component as it is generally described.

The present centrifugal jig is generally indicated at 10 in the accompanying drawings. The illustrated jigs are utilized to receive a slurry of pulp material 11 (FIGS. 2 and 6) and to separate the pulp into heavy fractions and lightweight fractions. A pulp feed 12 is provided as means to receive and direct pulp material into the jig. The pulp enters the jig and is directed to a rotating jig bed 13. A combination of centrifugally forced settling and positive pulsion is utilized in the area of the jig bed 13 to separate the pulp 11 into a heavy fraction 15 and a lightweight fraction 16. The heavy fraction 15 is directed to a receiver means 17 while a lightweight fraction or "tailings" 16 is discharged at 18.

The terms "heavy fractions" and "lightweight fractions" are used broadly herein to apply to those portions of any particulate material having different specific gravities. The present apparatus and method may therefore be used effectively to separate many different forms of materials. Gold, for example, may be collected in a concentrate while lower specific gravity material is discharged as "tailings". For another example, coal may be separated from higher specific gravity silicas and sulfides. In this case, the coal is collected where the "tailings" would be discharged in a gold concentrating operation.

As can be seen from the arrows designating direction of material flow in the drawings, material entering the jig bed of FIGS. 1-4 moves downward and "tailings" or the lightweight fractions are segregated at the lower end of the jig bed. This direction of flow is just opposite in FIGS. 5-7, where the material moves upwardly and the lightweight fractions are discharged at the top of the jig bed.

Both forms of the present jig assembly are comprised of two basic elements, a rotor 20 and a casing 21. The casing 21 is preferably held stationary and rotatably mounts the rotor 20. In FIGS. 1 through 4, the illustrated casing substantially surrounds the rotor 20. The casing 21 of the diagrammatic FIG. 5 version of the invention is a stationary base member that mounts the rotor 20 by bearings 19.

Associated with the rotor 20 is a pulp feed means 12. It is preferably comprised of a feed pipe 24 that is centrally located on the rotational axis of the rotor, although it may be held stationary on the casing 21, depending on the use intended. As shown in FIG. 1, bearings 25 may maintain the feed pipe in its axial relationship with the rotor. The bearings 25 also rotatably mount the remainder of the rotor elements to the casing 21 in the FIG. 1 form for rotation about the rotor axis. A packing 27 (FIG. 1) is provided about an annular rib 28 along an upper side of the rotor. Additional packing 29 (FIG. 1) is provided at a lower end of the rotor. Packings 27 and 29 are utilized to seal the rotor 20 within the casing 21 while assuring its relatively free rotation about the central axis.

An impeller 31 may also be included in the FIG. 1 version, as an element of the pulp feed 12. Here the feed pipe 24 leads to the impeller 31. Material moves onto the impeller 31 and is forced radially outward through a plurality of passages 32. The impeller is utilized to evenly distribute the pulp material about the rotational axis. A relatively uniform annular layer of pulp material can therefore be received by the jig bed 13.

The FIG. 5 embodiment does not make use of an impeller. Instead, it includes a number of radially extending delivery pipe sections 24*a* that extend from the central feed pipe 24. These pipes 24*a* are curved at their outward ends in the direction of rotation for the rotor in order to distribute the pulp material tangentially onto a substantially cylindrical batterboard 34.

The batterboard 34 is common to both forms of my jig and is included as a portion of the pulp feed 12. Batterboard 34 is situated adjacent the impeller 31 in the FIG. 1 version and closely adjacent to the outward curved ends of the pipes 24*a* in the FIG. 5 version. Pulp discharged from the tubes or impeller is received by the annular batterboard 34 which is centered on the rotational axis of the rotor. Batterboard 34 is also integral with the rotor 20.

The batterboard 34 leads to an annular edge 35 of the jig bed 13. This edge is defined by a wall of the jig bed that is substantially perpendicular to the rotor axis. The jig bed has a base at 36 that is defined by a cylindrical screen 37 (FIGS. 2 and 6) centered on the rotational axis of the rotor 20. The screen 37 is designed to receive and support "ragging" which may be metallic spheres 38 or appropriate particulate materials such as hematite, which are commonly used for such purposes. The cylindrical screen 37 holds the ragging against outward movement as the rotor is spun about its axis.

The screen 37 may be provided in the form of three separate overlapping cylindrical sections preferably woven of wire mesh. The two outer screen sections may be formed of a relatively heavy, wide mesh screening material. The center section sandwiched between the outer sections can be considerably lighter in weight and of a selected mesh size. For example, it may be preferable to use a mesh size smaller than 100 mesh for gold concentrates. The two outer screens would then serve as reinforcements to support and protect the more delicate inner screen. Other screen sizes and styles may be utilized, depending on the ore to be concentrated and the nature of the pulp.

The screen 37 is upright and leads axially from the surface defining edge 35 to a horizontal surface. This surface defines a jig bed edge 41 in FIG. 1. In the FIG. 5 embodiment, the edges 41 and 35 are reversed in position due to the reverse operational flow of material through the jig. In either embodiment, however, the edge 41 may extend radially outward beyond the screen 37 into the receiver means 17.

It is preferred that the two edges 35 and 41 be substantially radially spaced from the central rotating axis of the rotor by equal distances. However, the distances may be varied to have a corresponding effect on the operational depth of the resulting jig bed, so long as the jig bed itself across screen 37 remains cylindrical.

The lightweight fraction leaves the jig bed 13 through operation of a discharge means that includes the edge 41. The light fractions will move over edge 41 to be received by an annular discharge wall 43 of the FIG. 1 embodiment. The wall 43 is centered on the rotational axis of rotor 20 and is preferably upright. The wall 43 may be slightly flared downwardly to encourage increased flow rate of the lightweight fraction or "tailings" from the rotor. A receiving tank 44 is supplied directly below the open end of wall 43 for receiving the lightweight fraction. Tank 44 will collect the lightweight fraction for further handling or disposal.

In the FIG. 5 embodiment, no upright discharge wall is illustrated. Instead, the tailings merely move over the edge 41 to be collected at a position radially adjacent to the edge. The tailings of both forms may be collected, processed, and recirculated through the jig as necessary to assure complete practical concentration of the selected material.

The FIG. 1 version of casing 21 forms the receiver means 17 and is held stationary relative to the rotating jig bed. In the FIG. 5 version, however, an integral portion of the rotor forms the receiver means 17, rotating with the jig bed about the central axis.

The receiver means of the FIG. 1 version is defined by an upper casing plate 50 that is joined by an upright peripheral casing wall 51 to a lower casing plate 52. The receiver means enclosed within the casing 21 is thus annular and extends radially outward of the jig bed 13. It maintains an open fluid communication with the interior of the jig bed for receiving fluid and heavy fractions during rotation of the rotor. Along the lower plate 52 are a plurality of discharge orifices 53. The "hutch product" or fluid and heavy fractions are discharged through the orifices 53 to an appropriate concentrate collecting device such as a tank or other appropriate container (not shown).

The FIG. 5 version of the receiver means 17 rotates with the rotor. Here the receiver means 17 is defined by horizontal rotor walls 50*a* and 52*a* and a radially outward converging collector wall 51*a*. Rotation of the receiver means 17 with the jig eliminates turbulence within the area radially outward of the jig bed and facilitates collection of the concentrate through centrifugal force acting upon the concentrate to move it radially outward through orifices 53*a* and the converging walls 51. The concentrate may be delivered through the rotating periphery of the rotor to an annular collection housing 53*b*. The housing 53*b* as shown in FIG. 5 may be mounted adjacent to the rotor and held stationary by the casing 21. Appropriate vanes 53*c* may be provided on the exterior surfaces of the rotor adjacent the orifices 53*a* for creating cavitation within the collector housing 53*b* in order to prevent radial inward escape of fluid and concentrate from the joint between the housing and the rotor.

The annular area defining the receiver means 17 within the casing of the FIG. 1 embodiment is open to contain slurry of "hutch" fluid in communication with the jig bed. The hutch fluid is preferably directed into the receiver means 17 through two or more equally spaced apertures 54. The apertures 54 are formed through the upper plate 50 but may be provided elsewhere along the casing. Apertures 54 are connected to a valved pump 56 for pumping the fluid under pressure. The pumped fluid fills the entire annular receiver area or hutch and maintains fluidic communication with the jig bed 13. This area is also where heavy fractions (concentrate) are received and directed toward the orifice 53.

In the FIG. 1 embodiment the fluid is pumped into the casing in pulsations formed by the valved pump 56. The fluid is thus pulsed radially inward to intermittently produce a fluidic bed inwardly adjacent the rotating screen 37, through which the heavy fractions may settle by the known "hindered settling" process.

The settling process is substantially accelerated, however, by centrifugal force acting against the "heavys" or high specific gravity particles due to the rotating jig bed.

At the termination of each pulsation, the ragging and pulp within the jig bed are allowed to settle radially outward against the screen 37. Alternate positive pulsations will therefore serve to eventually "jig" the lightweight fractions over edge 41 along with a portion of the "hutch" fluid carrying the pulp while the heavy fraction remains within the jig bed and settles through the screen into receiver means 17. The centrifugal forces, being much greater than the force of gravity, cause even extremely fine particles of heavy fractions to settle through the ragging and screen 37. The heavy fractions then migrate radially outward due to centrifugal force, to be collected adjacent the discharge orifices 53.

It is noted that the pulse produced in the FIG. 1 embodiment is supplied through the valved pump 56. Alternatively, the pulse produced by the FIG. 5 embodiment is supplied through an integral pulsator 60 that fits within the rotor itself.

The pulsator 60 includes an upright hollow shaft 61 for receiving fluid from a pressurized source such as a standard commercial water pump. It is preferred that the fluid be delivered under constant pressure to the pulsator 60.

The shaft 61 leads upwardly to a pulsator head 62. The head 62 is hollow and openly communicates with the interior of the shaft 61. The pulsator head includes a peripheral inclined pulsator wall 63 that is centered on the central rotor axis and includes a frusto-conical configuration. Preferably two opposed openings 64 are formed through the walls.

The rotor receives the pulsator head 62 within a complementary recess that includes a peripheral rotor wall 70 spaced slightly outwardly of the peripheral pulsator head wall 63 and includes opposed openings 71 formed therethrough. The openings 71 are movable with the rotor in circular paths the intersect the openings 64. As the rotor spins about its central axis, the openings 71 will therefore periodically come into open communication with the pulsator head openings 64. The pressurized fluid will be allowed to flow in successive pulsations through the aligned openings and into the hutch area. The fluid pulsations are then carried through the fluid to the jig bed where they function to intermittently create a fluidic bed of the pulp material.

The pulsator head is held stationary by the casing 21 but is adjustable vertically by a bypass means that includes an adjusting nut 69 situated at an outward end of the shaft. The nut 69 threadably engages the shaft and the casing 21 in order to axially adjust the position of the pulsator head in relation to the adjacent components of the rotor.

The purpose of the bypass means in providing axial adjustment of the pulsator head is to control seepage from the pulsator head directly into the receiver means 17. The wall surfaces of the pulsator head and rotor wall will normally substantially nest together and therefore very little seepage will be allowed from opening 70 into the hutch area. However, if the adjusting nut is turned to move the shaft and the affixed pulsator head axially with respect to the rotor wall, the gap between rotor wall 70 and pulsator wall 63 will increase and additional fluid will be allowed to enter the hutch and jig bed. The steady seepage applies a continuous positive pressure to the fluid within the hutch and yet allows the positive pulsations to elevate the pressure intermittently to pulsate the jig bed.

Selective adjustment of seepage volume or rate may be used when the present jig is to be utilized to separate different ores. It is also noted that the pulse produced through either the pump 56 or the pulsator head can be varied in duration, pressure, and frequency, depending upon the type of ore, the flow rate of the pulp, and the rotational velocity of the rotor.

It has been found through experimentation that the rotor velocity must be maintained at a rate sufficient to produce a corresponding outward centrifugal force at the screen of at least ten times that of gravity. If the ratio of centrifugal force to gravitational force does not equal at least ten to one, the resultant angle of repose of the jig bed on the cylindrical screen may become such that boiling will occur. At forces above 10 G's, the angle of repose gradually approaches an angle perpendicular to the radial lines of force generated from the central rotational axis. The jig bed will therefore become substantially cylindrical (as shown by FIG. 6) and retain a uniform radial depth from top to bottom during rotation imparting 10 G loading.

Both the ragging and pulp or feed materials are loosely held by the screen and will naturally drop downwardly out of the jig bed when the rotor is stopped. For this reason flow of fluid is stopped and the rotor is run dry for a period before rotation is stopped. The dried pulp and ragging will then adhere to the screen and stay in place.

The present method may now be easily understood in terms of operation of the above described apparatus.

Prior to initiating operation of the present jig, the rotor is powered by an appropriate drive mechanism 80 (FIG. 5) to rotate about its axis. Preferably, the rotor is driven to rotate about its center axis at a velocity sufficient to bring the ragging against the screen with a force of ten times that of gravity (10 G's) or higher. The fluid supply mechanism may then be actuated to start pulsations through the screen. A supply of pulp material is directed to the feed pipe 24, by a conventional mechanism (not shown) selected to deliver the pulp material in a slurry at a rate compatible to the operating rate and size of the jig.

In the FIG. 1 embodiment the pulp slurry will move downwardly and be received by the impeller 31. Material striking the impeller will be guided radially outward through the passages 32 to the batterboard 34. Since the batterboard and impeller rotate simultaneously, there is only a slight shearing effect produced between the rotating board and the outwardly moving pulp. The pulp will therefore almost immediately rotate in unison with the batterboard.

The rotational rate of the rotor will be such that the pulp material will be held against the batterboard by centrifugal force. Gravity and reception of additional material along the batterboard act to cause the previously received material to move downwardly and over the upper edge 35 of jig bed 13. As indicated above, the step of rotating the jig bed (since it is physically integral with the rotor) is accomplished as the rotor is actuated.

In the FIG. 5 embodiment, the slurry of pulp is delivered through the radial tubes 24*a* directly to the batterboard. The incoming slurry displaces previously delivered slurry and thus forces it upwardly along the batterboard to the jig bed and eventually out over the discharge edge at 41.

It should be noted that either embodiment may be inverted or turned at substantially any angle. The jig will still function efficiently. Therefore, it is irrelevant whether the pulp material enters below or above the jig bed. The pulp can be made to flow both axially and radially when delivered from above or below.

The step of "jigging" the pulp within the jig bed is accomplished by producing fluid flow in a series of fluid pulsations directed radially inward through the jig bed. The duration, frequency, and pressure of the pulsations may be variable depending upon the ore intended for collection. Radial inward movement of the fluid will suspend the pulp material in a fluidic bed.

The heavy fractions settle through the ragging and against or through the screen upon termination of each pulsation. As the positive pulsation terminates, centrifugal force quickly overcomes the radial inward force of the pulsation and causes more rapid outward movement of the heavy fractions toward the screen than the same movement of the lightweight fractions. The lightweight fractions or lower specific gravity particles will remain at a level within the jig bed and eventually will move gradually toward the discharge edge 41. After several successive pulsations, the lower specific gravity material will have worked its way over the discharge edge 41 and will proceed toward discharge and reception within the receiving tank 44 (in the FIG. 1 form). Flow of the lightweight fractions is assisted by steady inward flow of the pulsating fluid, some of which escapes through the jig bed and is discharged with the tailings.

Collecting the heavy fraction is accomplished by providing outlet orifices 53, 53*a* radially outward of the jig bed. The heavy fraction is received through the screen and moves through the hutch area radially outward to migrate through the discharge orifices 53, 53*a*. Middlings, if any are produced, are retained within the ragging and against the screen.

In the FIG. 5 embodiment the pulsations of the fluid are produced through rotation of the rotor as the wall openings 71 move in their circular paths to periodically communicate with the openings 64 in the stationary pulsator head. Fluid delivered through the pulsator head under constant pressure will thus be delivered to the jig bed in positive pulsations in response to rotation of the rotor.

The present method utilized in conjunction with either embodiment may also include the step of allowing a select amount of seepage to the jig bed. This may be done, for example, by the adjusting nut and thread adjustment of the bypass means on the pulsator shaft described above in the FIG. 5 embodiment. It may also be done by allowing seepage through the valved pump 56 of the FIG. 1 form.

The pulating fluid carries the tailings over the edge 41 of the jig bed. The tailings and expelled fluid will readily flow into an associated receptacle. This procedure comprises the final step of discharging the lightweight fraction.

It is to be noted that the present method is continuous and that the steps described above occur simultaneously. Pulp is fed into the apparatus while pulp is being segregated on the jig bed. The pulp material is continuously separated into heavy fractions and lightweight fractions with the heavy fractions being discharged through the orifices 53 as the lightweight fractions are being discharged over edge 41.

The above description and attached drawings are given merely by way of example to set forth a preferred and alternate form of the present invention and apparatus. The following claims are given to more restrict the scope of the present invention.

What I claim is:

1. A centrifugal jig for separating a heavy fraction from a lightweight fraction of a pulp material, comprising:

a casing;

a hollow rotor mounted to the casing about a rotor axis;

a cylindrical jig screen mounted coaxially to the rotor for rotation therewith about the rotor axis for receiving pulp material to form a cylindrical jig bed;

means for rotating the rotor and cylindrical jig screen about the rotor axis at sufficient velocity to cause centrifugal loading on the cylindrical jig screen at least equal to ten times the force of gravity;

feed means for directing pulp material onto the cylindrical jig screen;

means for simultaneously directing positive fluid pulsations radially inward through the total circumference of the jig screen to form a uniform layered cylindrical pulsating fluidic bed of the pulp material on the cylindrical jig screen as it is rotated about the rotor axis;

discharge means adjacent the cylindrical jig screen adapted to receive a lightweight fraction of the pulp material; and receiver means in communication with the exterior of the jig screen for receiving fluid and the heavy fraction of the pulp material from the jig screen during rotation of the rotor means.

2. The centrifugal jig as defined by claim 1 wherein the pulp feed means includes a pulp delivery pipe leading into the rotor for directing pulp radially toward the jig bed.

3. The jig as defined by claim 1 wherein the receiver means is formed within the casing and extends annularly about the rotor means.

4. The jig as defined by claim 1 wherein the receiver means extends annularly about the rotor and rotates with the rotor.

5. The jig as defined by claim 1 wherein the pulp feed means includes a pulp delivery pipe leading into the rotor and wherein the pulp delivery pipe is coaxial with the rotor axis.

6. The jig as defined by claim 1 wherein the cylindrical jig screen is positioned within an inwardly facing annular recess formed in the rotor.

7. The jig as defined by claim 1 wherein the means for directing fluid pulsations further comprises pulsator means operatively connected to the rotor for receiving fluid under constant positive pressure and for supplying pulsations of the pressurized fluid through the jig screen in response to rotation of the rotor.

8. The jig as defined by claim 7 wherein the pulsation producing means includes fluid bypass means for allowing a constant seepage of pressurized fluid from the pulsation producing means and through the cylindrical jig screen;

and adjusting means for selectively varying the rate of seepage flow.

9. A method for separating a heavy fraction from a lightweight fraction contained in a pulp material, comprising the steps of:

(a) placing the slurry of pulp material in a cylindrical jig bed;

(b) rotating the cylindrical jig bed about its central axis at sufficient velocity to cause centrifugal loading on the cylindrical jig bed at least equal to ten times the force of gravity so as to force the slurry of pulp material radially outward by centrifugal force;

(c) simultaneously jigging the pulp material within the rotating cylindrical jig bed by positively pulsing a fluid radially inward simultaneously through the total circumference of the rotating cylindrical jig bed to form a uniform, layered cylindrical pulsating fluidic bed through which the heavy fraction will settle radially outward and the lightweight fraction will migrate toward a discharge;

(d) collecting the heavy fraction; and (e) separately discharging the lightweight fraction.

10. The method as set out by claim 9 wherein the step of placing the pulp into the cylindrical jig bed is accomplished by:

(a) moving the pulp material axially to an elevation adjacent the jig bed;

(b) moving the pulp material at said elevation radially outward to a rotating annular batterboard; and (c) moving the slurry of pulp material axially from the rotating batterboard to the rotating jig bed.

11. The method as set out by claim 9 wherein the steps of jigging the pulp and collecting the heavy fractions therefrom are accomplished by:

(a) providing a cylindrical screen at a base of the jig bed;

(b) providing ragging along the base radially inward of the cylindrical screen to form interstices through which the heavy fraction may settle; and (c) directing the fluid pulsations radially inward through the screen and interstices of the ragging to fluidize the jig bed and allow settling of the heavy fraction through the ragging interstices as assisted by centrifugal force produced through the rotating cylindrical jig bed.

12. The method as set out by claim 9 wherein the step of rotating the jig bed is accomplished about an upright rotational axis.

13. The method as set out by claim 12 wherein the step of jigging the pulp material within the rotating jig bed is accomplished by directing a fluid around the exterior of the jig bed and pulsing the fluid radially inward through the jig bed.

14. The method as set out by claim 9 wherein the step of collecting the heavy fraction is accomplished by providing annular hutch means in fluid communication with the exterior of the cylindrical jig bed for receiving the heavy fraction during rotation of the jig bed.

15. The method as set out by claim 14 wherein the step of collecting the heavy fraction further comprises the step of rotating the last annular hutch means with the jig bed.

16. The method as set out by claim 9 wherein the steps of placing the pulp material into the cylindrical jig bed, rotating the jig bed, and jigging the pulp material are all performed simultaneously.

17. The method as set out by claim 9 wherein the step of rotating the jig bed is accomplished about an upright rotational axis.

18. The method as set out by claim 9 wherein the step of jigging the pulp material is accomplished by:

(a) journalling a pulsator head within the rotor with an annular pulsator wall centered on the rotor axis;

(b) delivering a fluid under constant pressure to the pulsator head;

(c) positioning an annular rotor wall within the rotor adjacent the pulsator head;

(d) holding the pulsator head against rotation about the rotor axis relative to the rotor wall;

(e) moving an opening through the annular rotor wall in circular paths past a similar opening in the annular pulsator wall intersecting the opening in the rotor wall so fluid delivered to the pulsator head under constant pressure will be delivered to the jig bed in positive pulsations in response to rotation of the rotor.

19. The method as set out by claim 18 comprising the further step of allowing seepage of the fluid from the pulsator head to the jig bed.

20. The method as set out by claim 19 comprising the further step of selectively controlling the rate of seepage of fluid from the pulsator head.

* * * * *